US009861841B1

(12) United States Patent
Hung

(10) Patent No.: US 9,861,841 B1
(45) **Date of Patent: *Jan. 9, 2018**

(54) FALL PROTECTION DEVICE

(71) Applicant: YOKE INDUSTRIAL CORP., Taichung (TW)

(72) Inventor: Wei-Chieh Hung, Taichung (TW)

(73) Assignee: YOKE INDUSTRIAL CORP., Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 15/226,745

(22) Filed: Aug. 2, 2016

(51) Int. Cl.
*A62B 35/00* (2006.01)

(52) U.S. Cl.
CPC ..... *A62B 35/0093* (2013.01); *A62B 35/0043* (2013.01)

(58) Field of Classification Search
CPC ..... A62B 35/0093; A62B 35/0043
See application file for complete search history.

(56) References Cited

U.S. PATENT DOCUMENTS 4,846,313 A * 7/1989 Sharp ..... A62B 35/0093 188/187
4,877,110 A * 10/1989 Wolner ..... A62B 35/0093 182/18
5,186,289 A * 2/1993 Wolner ..... A62B 1/12 182/232
8,181,744 B2 * 5/2012 Parker ..... A62B 1/10 182/232
2009/0178887 A1 * 7/2009 Reeves ..... A62B 1/10 182/239
2010/0252366 A1 * 10/2010 Jones ..... A62B 35/0093 182/232
2014/0251731 A1 * 9/2014 Jones ..... A62B 35/04 182/231

* cited by examiner

*Primary Examiner* — Alvin C Chin-Shue
(74) *Attorney, Agent, or Firm* — Lynette Wylie; Apex Juris, pllc.

(57) ABSTRACT

A fall protection device adapted to be connected to a safety belt is provided, including a frame forming a containing space, a shaft lever provided on the frame, a retard member, and a rotary drum. The retard member is pivotally provided on the shaft lever rotatably, which is received in the containing space, and has a friction surface. The rotary drum is fitted around the retard member, and has an outer surface and an inner surface; the outer surface is adapted to be winded by the safety belt, and the inner surface faces to the friction surface. In a first operating state, the retard member and the rotary drum rotate coaxially. In a second operating state, the rotary drum rotates relative to the fixed retard member. A rotational friction is generated between the friction surface and the inner surface, which slows down the rotational speed of the rotary drum.

12 Claims, 5 Drawing Sheets

FALL PROTECTION DEVICE

BACKGROUND OF THE INVENTION

1. Technical Field

The present invention relates generally to a safety device, and more particularly to a fall protection device suitable for high altitude environments.

2. Description of Related Art

Generally, workers are requested to be equipped with fall protection equipment while working in high altitude environments such as a rooftop, factory, elevator, shipbuilding yard, aerospace site, and construction site, wherein a commonly seen fall protection equipment usually includes a safety belt which ties a worker securely. Whereby, if a worker accidentally falls from high altitude, the fall protection equipment can instantly lock the safety belt or decelerate the fall to prevent the worker from continuously falling, or to slow down the fall speed, which ensures the worker's safety.

One type of the fall protection equipment available in the market is designed to include an elastic safety belt, which is helpful to decelerate the fall when a worker tied with the safety belt falls. However, the length and the elastic coefficient of such safety belt have to be taken into consideration according to the altitude of the working environments and the body weight of the worker; otherwise the safety belt may fail to rebound in time before the worker falling to the ground.

Moreover, another type of the fall protection equipment is specifically designed that the safety belt thereof has a stitched folded section. Whereby, when a worker tied with the safety belt falls, the stitched folded section would be torn apart to absorb part of the falling energy to decelerate the fall. However, such design would damage the structure of the safety belt, which may decrease the strength and the bearing capacity and, therefore, may be potentially dangerous.

In addition, yet another type of fall protection equipment can instantly lock the safety belt when a worker attached thereto falls, to prevent the worker from continuously falling. Though such design could stop the fall, the sudden impact (e.g., G-Force) and the reaction force generated at the very moment that the fall protection equipment locks the safety belt may cause internal injuries or even break bones. In this sense, the conventional fall protection equipment still has room for improvement.

BRIEF SUMMARY OF THE INVENTION

In view of the above, the primary objective of the present invention is to provide a fall protection device for preventing workers from falling from high altitude.

The present invention provides a fall protection device, which is adapted to be connected to a safety belt, including a frame, a shaft lever, a retard member, and a rotary drum. The frame forms a containing space; the shaft lever is provided on the frame. The retard member is pivotally provided on the shaft lever rotatably, wherein the retard member is received in the containing space, and has a friction surface. The rotary drum is fitted around the retard member, wherein the rotary drum has an outer surface and an inner surface; the outer surface is adapted to be winded by the safety belt, and the inner surface faces to the friction surface of the retard member. In a first operating state, the retard member and the rotary drum rotate coaxially; in a second operating state, the retard member is fixed, while the rotary drum rotates relative to the retard member, wherein a rotational friction is generated between the friction surface of the retard member and the inner surface of the rotary drum, which slows down the rotational speed of the rotary drum.

Whereby, with the design of the fitting between the friction surface of the retard member and the inner surface of the rotary drum, in the first operating state, the normal use state, the retard member retard member would not affect the rotation of the rotary drum. If the worker accidentally falls from high altitude and accordingly in the second operating state, the rotational friction would be generated between the retard member and the rotary drum, which reduces the rotational speed of the rotary drum. Whereby, the fall speed of the safety belt would be lowered.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
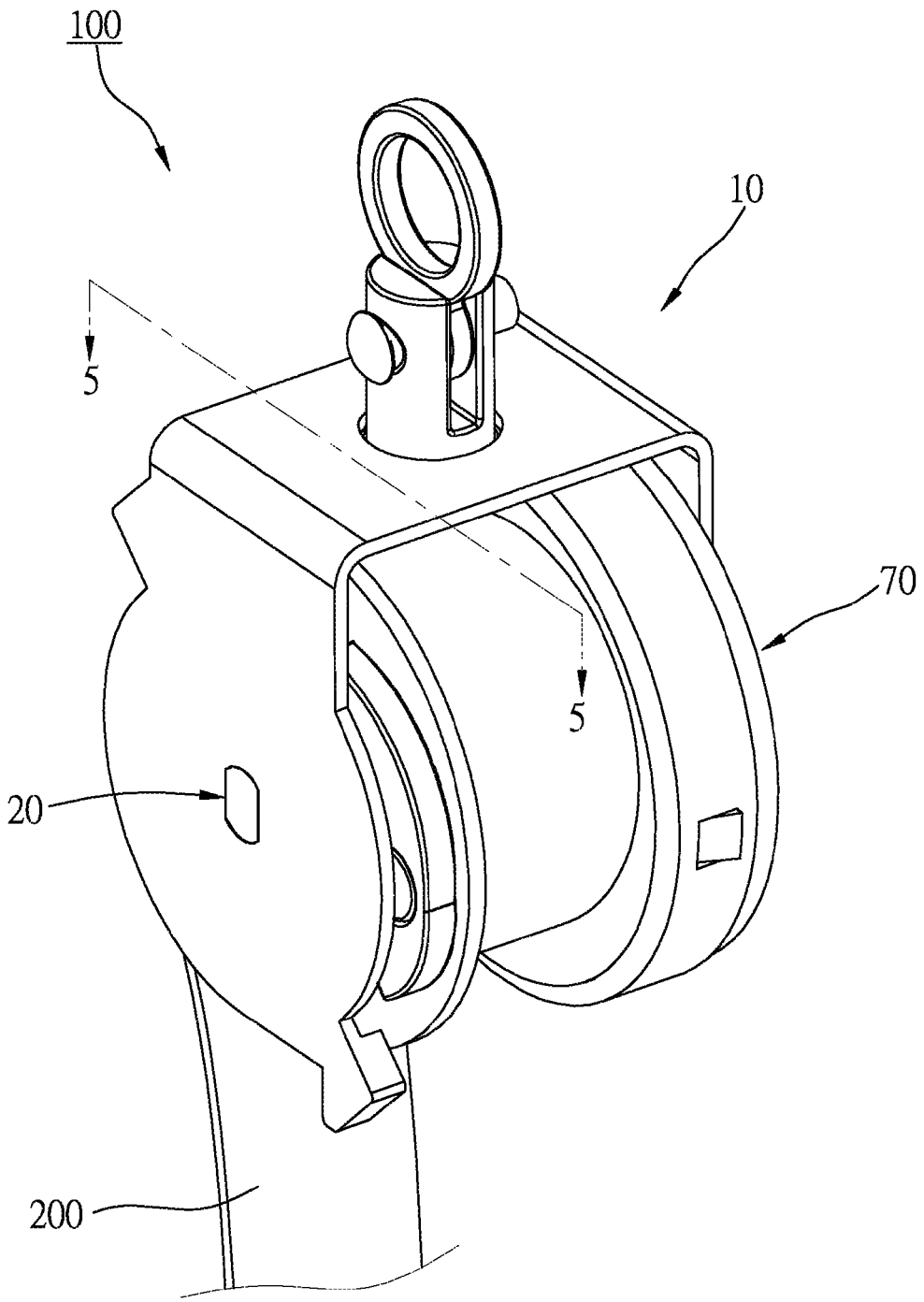
FIG. 1 is a perspective view of a preferred embodiment of the present invention, showing the fall protection device for preventing workers from falling.
Figure 2:
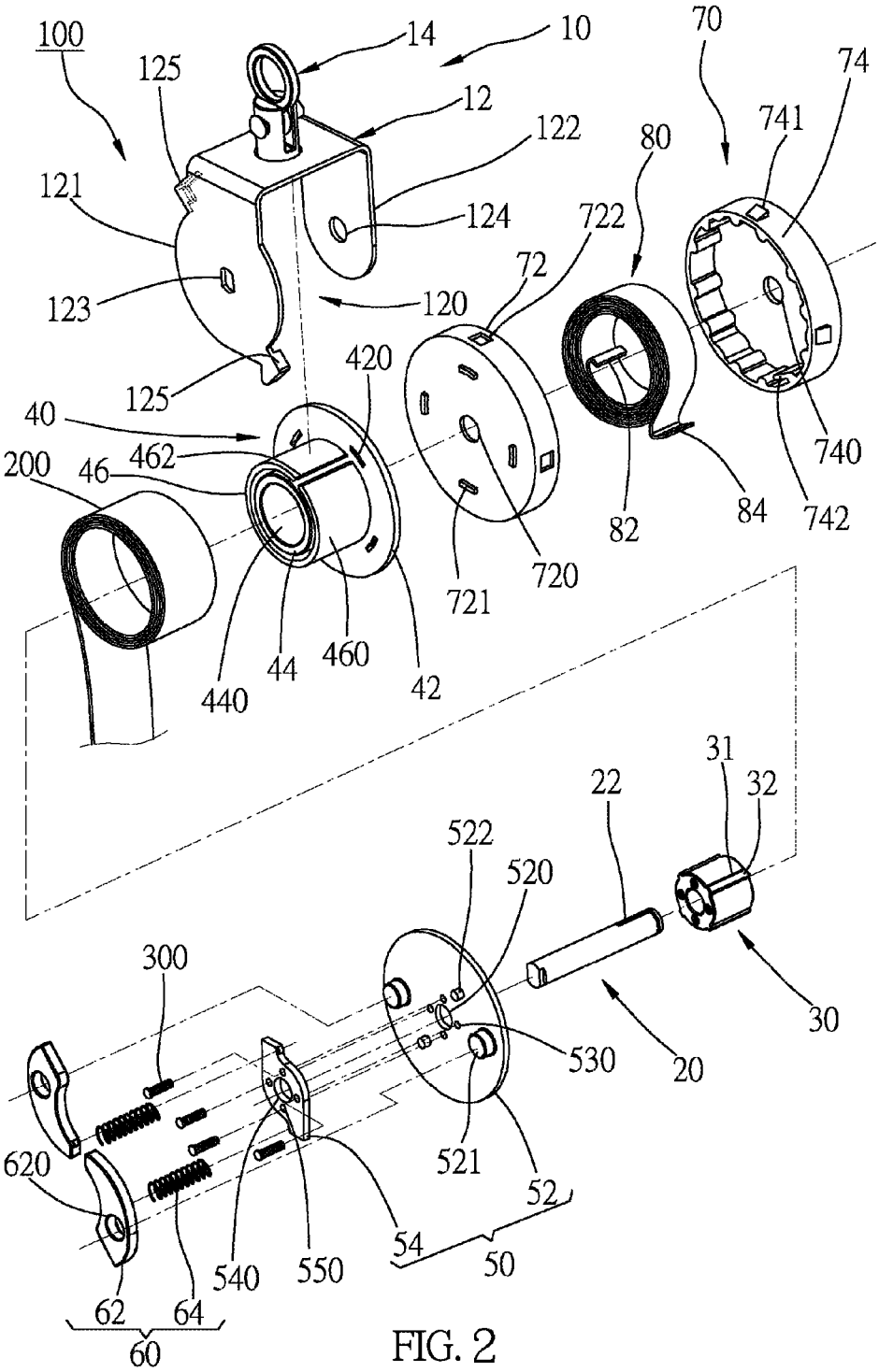
FIG. 2 is a exploded view of the fall protection device in FIG. 1.

As shown in FIG. 1 and FIG. 2, a fall protection device 100 is adapted to be connected to a safety belt 200, which is used to tie a worker securely. The fall protection device 100 includes a frame 10, a shaft lever 20, a retard member 30, a rotary drum 40, a turntable 50, a brake assembly 60, a side cover 70, and a spiral spring 80.

The frame 10 includes a hanger frame 12 and a hanging ring 14 connected to the top of the hanger frame 12. The hanger frame 12 is inverted U-shaped, which forms a containing space 120, and has two lateral boards 121 and 122 facing each other. The two lateral boards 121 and 122 have two shaft holes 123 and 124 respectively at two corresponding positions. Additionally, the lateral board 121 has a first stop portion 125 formed thereon; in the preferred embodiment, the lateral board 121 has two first stop portions 125, wherein the connecting line between the two first stop portions 125 passes through the shaft hole 123. The two first stop portions 125 are protrusions protruded from the lateral board 121 toward the containing space 120. The hanging ring 14 is adapted to be hung on or fixed to a firm support, such as a cable or a beam column.

Two ends of the shaft lever 20 are respectively engaged in and fixed to the two shaft holes 123, 124. Moreover, the outer surface near one of the two ends has a groove 22, wherein an extending direction of the groove 22 is parallel to an axial direction of the shaft lever 20. The groove 22 is adapted to be engaged with an end of the spiral spring 80 to prevent the shaft lever 20 form rotating relative to the frame 10.

The retard member 30 is pivotally provided on the shaft lever 20 rotatably, and is received in the containing space 120. The retard member 30 has a friction surface 31; in the preferred embodiment, the retard member 30 has a plurality of ribs 32 separately arranged on the outer surface thereof, wherein a top surface of each of the ribs 32 forms the friction surface 31. In addition, a plurality of screw holes 33 are provided on an end surface of the retard member 30.

Figure 5:
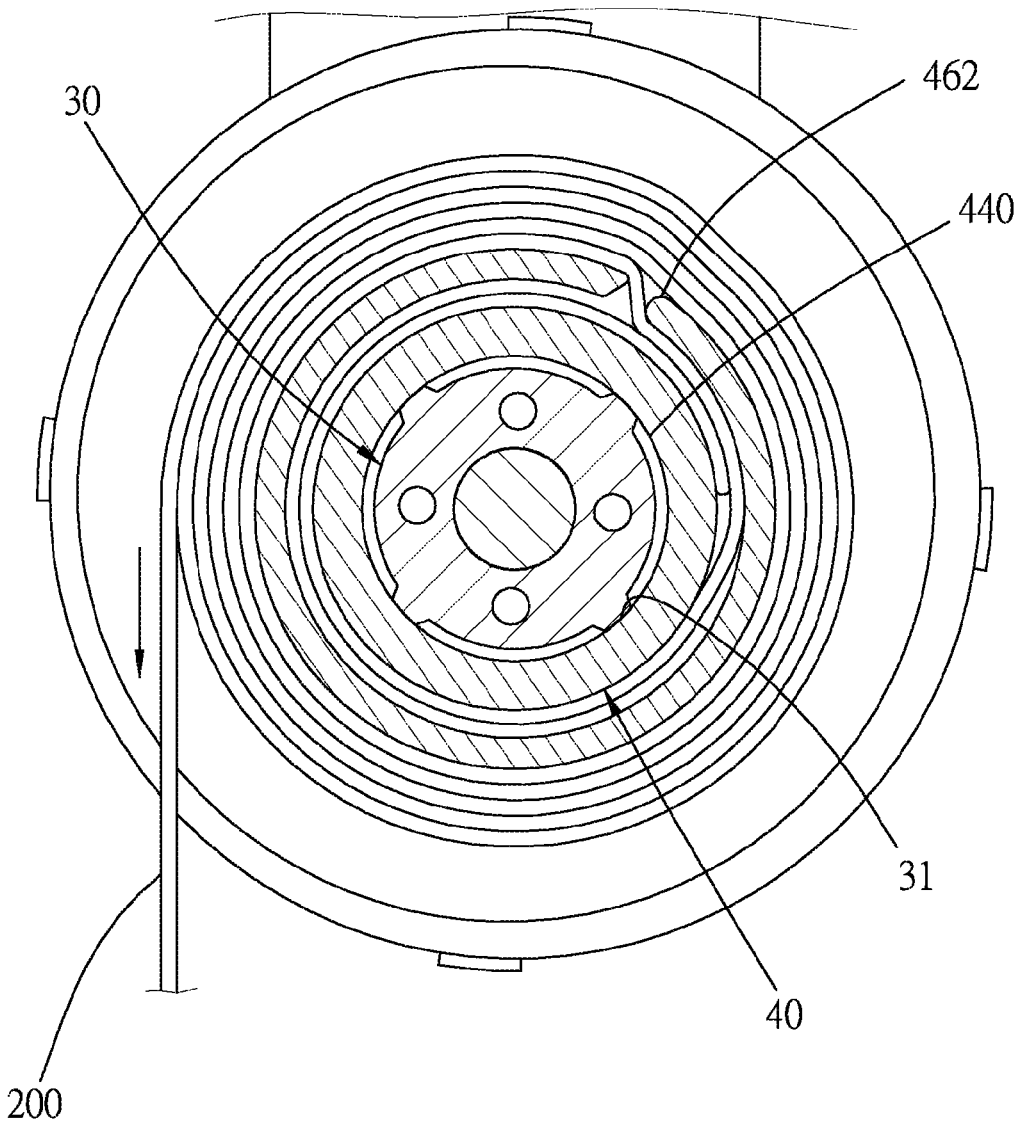
FIG. 5 is a sectional view along the 5-5 line in FIG. 1.

The rotary drum 40 is fitted around the retard member 30, and includes a disc base 42, a sleeve 44, and a collar 46. The disc base 42 has four symmetrically arranged positioning holes 420. The sleeve 44 is connected to a side of the disc base 42, and has an inner surface 440 facing to the friction surface 31 of the retard member 30. The collar 46 is provided around the sleeve 44, and has an outer surface 460 and a gap 462. As shown in FIG. 5, in the preferred embodiment, an end of the safety belt 200 is caught between the sleeve 44 and the collar 46; another portion of the safety belt 200 is stretched out from the gap 462, and then winded around the outer surface 460 of the collar 46. However, in another embodiment, the rotary drum 40 merely includes the disc base 42 and the sleeve 44, while the collar 46 is not necessarily provided. With such design, an outer surface of the sleeve 44, which is opposite to the inner surface 440, is adapted to be winded by the safety belt 200.

The turntable 50 includes a main body 52 and a positioning member 54, wherein the main body 52 has a center hole 520; one end of the shaft lever 20 passes through the center hole 520 such that the main body 52 is pivotally provided on the shaft lever 20. The main body 52 is received in the containing space 120, and is provided on a side of the rotary drum 40. Moreover, a plurality of through holes 530 is provided around the center hole 520; the main body 52 has two pivot columns 521 and two restrict columns 522 provided on a lateral surface thereon. The positioning member 54 is connected to a side of the main body 52, and has a center hole 540 and a plurality of through holes 550, wherein one end of the shaft lever 20 passes through the center hole 540 such that the positioning member 54 is pivotally provided on the shaft lever 20 上. Additionally, a plurality of bolts 300 respectively pass through corresponding through holes 550 of the positioning member 54, the through holes 530 of the main body 52, and afterward are threaded into corresponding screw holes 33 of the retard member 30. Accordingly, the positioning member 54, the main body 52, and the retard member 30 are fixed together, and are able to rotate coaxially (or synchronously). In addition, in another embodiment, the main body 52 and the positioning member 54 are integrated.

Figure 3:
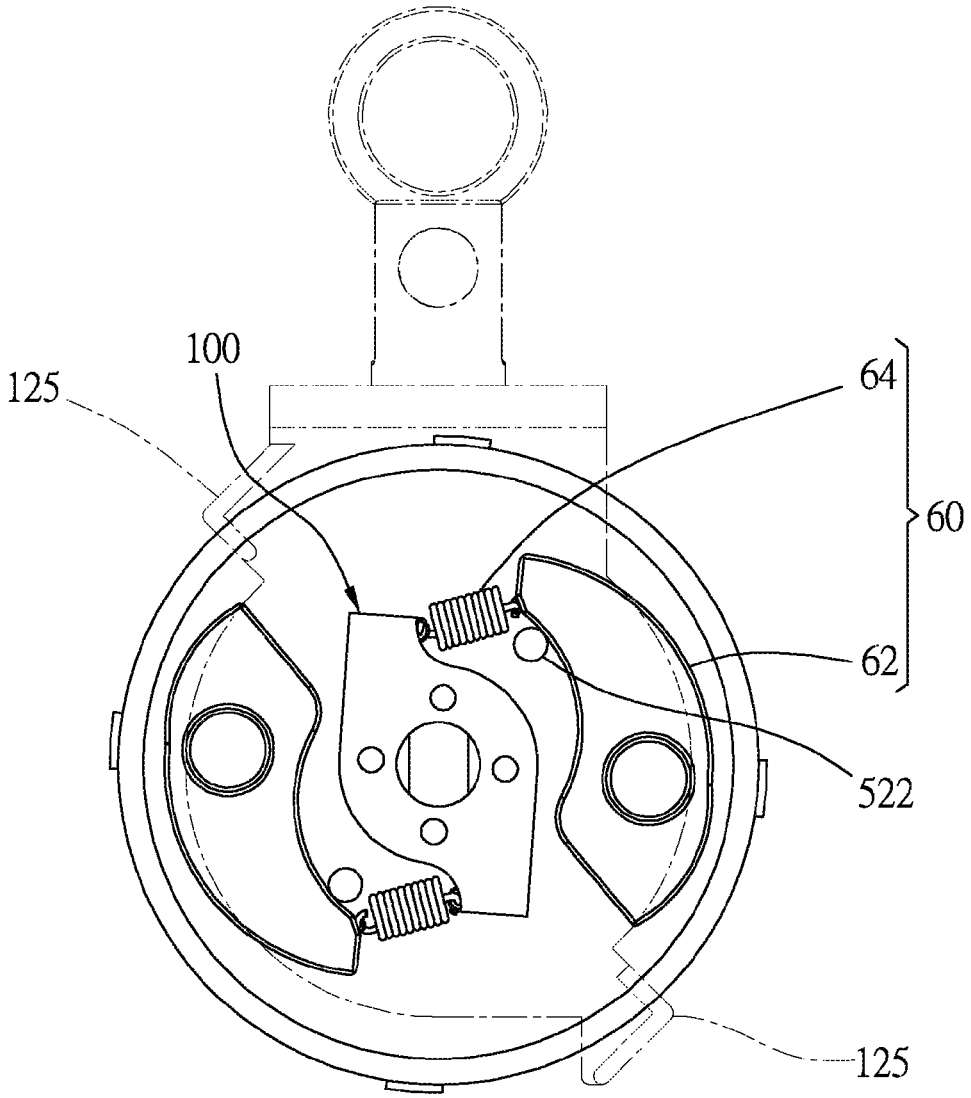
FIG. 3 is a lateral perspective view of the fall protection device in FIG. 1, showing the brake assembly positioned without contacting with the frame.

As illustrated in FIG. 2 and FIG. 3, in the preferred embodiment, the fall protection device 100 includes two brake assemblies 60; for the explanatory purpose, the structure of one of the two brake assemblies 60 is specified as follows. The brake assembly 60 includes a brake part 62 and a return spring 64, wherein the brake part 62 has a pivot hole 620, the brake part 62 is fitted with the pivot columns 521 by the pivot hole 620 thereof to be pivotally connected to the turntable 50. The return spring 64 is connected to the brake part 62 and the positioning member 54 with two ends thereof respectively. In the sense, the return spring 64 provides an elasticity to position the brake part 62 in a retracted position; in other words, the brake part 62 is pulled by the return spring 64 to be positioned in contact with the restrict columns 522 rather than contacting with the frame 10.

The side cover 70 is received in the containing space 120, and is connected to the rotary drum 40 to rotate with the rotary drum 40 coaxially. In the preferred embodiment, the side cover 70 includes a first cover 72 and a second cover 74. The first cover 72 has a center hole 720, and a plurality of protrusions 721 are provided on a surface which faces to the rotary drum 40, wherein the protrusions 721 are adapted to be correspondingly engaged with the positioning holes 420 of the disc base 42, which makes the side cover 70 and the rotary drum 40 fixed together and rotate synchronously. Moreover, a plurality of engaging holes 722 are provided on the outer peripheral surface of the first cover 72, while the second cover 74 has a center hole 740 and a plurality of protrusions 741 provided on the outer peripheral surface of the second cover 74, wherein the protrusions 741 are adapted to be correspondingly engaged with the engaging holes 722, which forms a space between the first cover 72 and the second cover 74 to contain the spiral spring 80.

An end 82 of the spiral spring 80 is engaged with the groove 22 of the shaft lever 20, while another end 84 is fixed to the second cover 74. In the preferred embodiment, a plurality of protrusions 742 are projected from the inner surface of the second cover 74, and are separately arranged, wherein the end 84 of the spiral spring is fixed between two adjacent protrusions 742.

A first operating state is defined when a worker is working stably, such as walking on a working platform or a pallet. In said first operating state, the brake assembly 60 is kept in the retracted position without contacting with the first stop portion 125 of the frame 10, and accordingly the turntable 50 and the retard member 30 can coaxially (or synchronously) rotate with the rotary drum 40 and the side cover 70. In addition, when the worker tied with the safety belt 200 is away from the fall protection device 100, which draws the safety belt 200, the spiral spring 80 would be stretched along with the drawing of the safety belt 200, because the end 84 of the spiral spring 80 is fixed to the side cover 70. Therefore, the spiral spring 80 would store a restoring force (or so-called elasticity). On the other hand, when the worker is close to the fall protection device 100, the force to draw the safety belt 200 is smaller than the elasticity of the spiral spring 80, and therefore the spiral spring 80 would be elastically restored to a coil, which drives the safety belt 200 to wind around the rotary drum 40.

Figure 4:
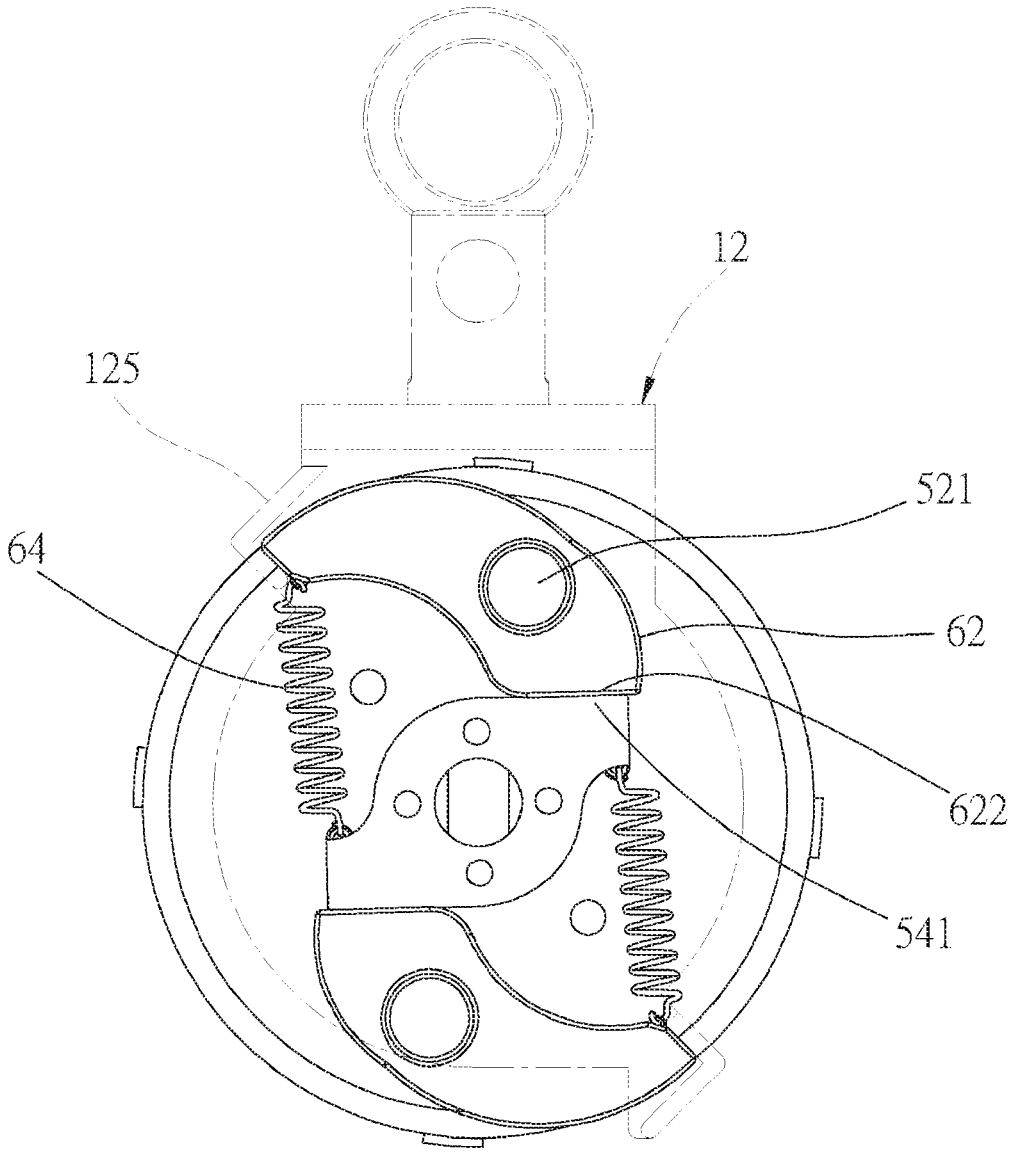
FIG. 4 is a lateral perspective view of the fall protection device in FIG. 1, showing the brake assembly swung by the torque; the brake part is engaged with the first stop portion of the frame.

In contrast, a second operating state is defined when the safety belt 200 is suddenly stretched, e.g., when the worker tied with the safety belt 200 falls from high altitude. As shown in FIG. 3 to FIG. 5, the brake part 62 is swung by a torque or a centrifugal force against to the elastic force of the return spring 64, wherein the pivot columns 521 is the fulcrum, to be engaged with the first stop portion 125 of the hanger frame 12 with a first portion 621 thereof, while a second portion 622 of the brake part 62 abuts against a second stop portion 541 of the positioning member 54. In this sense, the turntable 50 is fixed by the engagement of the brake assembly 60 and the hanger frame 12, and the retard member 30 is fixed as well. The rotary drum 40 is continuously rotating due to the stretching of the safety belt 200 afterwards, and a rotational friction is generated between the friction surface 31 of the retard member 30 and the inner surface 440 of the rotary drum 40 when the rotary drum 40 is rotating relative to the retard member 30, which slows down the rotational speed of the rotary drum 40 and the fall speed of the safety belt and the worker.

In addition, to effectively slow down the rotational speed of the rotary drum 40 and the fall speed of the safety belt and the worker, a fit tolerance between the inner surface 440 of the rotary drum 40 and the friction surface 31 of the retard member 30 is between 0 mm and 0.3 mm, in other words, the absolute value of the shortest distance between the inner surface 440 and the friction surface 31 is between 0 mm and 0.3 mm. Said fit tolerance is selected by the bearing capacity of the fall protection device 100 and the body weight of the worker.

In another embodiment, the fitting of the inner surface 440 of the rotary drum 40 and the friction surface 31 of the retard member 30 can be press fit including clearance fit, transition fit, or interference fit according to the demand for the use or the material properties of the fall protection device 100.

Additionally, the protrusions 742 can not only lighten the weight of the side cover 70 under enough structural strength but also retain foreign objects with interstices among the protrusions 742 without influencing the moving of the spiral spring.

Moreover, in other embodiments, the fall protection device may include one or more than two brake assemblies 60.

It is noted that the fall protection device 100 is adapted not only to a worker but also to objects such as construction materials and machinery to slow down the fall speed of the objects.

It must be pointed out that the embodiments described above are only some preferred embodiments of the present invention. All equivalent structures which employ the concepts disclosed in this specification and the appended claims should fall within the scope of the present invention.

What is claimed is:

1. A fall protection device, which is adapted to be connected to a safety belt, comprising:

a frame forming a containing space;

a shaft lever provided on the frame;

a retard member pivotally provided on the shaft lever rotatably, wherein the retard member is received in the containing space, and has a friction surface;

a rotary drum fitted around the retard member, wherein the rotary drum has an outer surface and an inner surface; the outer surface is adapted to be wound by the safety belt, and the inner surface faces to the friction surface of the retard member;

a turntable pivotally provided on the shaft lever, wherein an end surface of the retard member is fixed to the turntable; and a brake assembly, wherein the brake assembly comprises a brake part; the brake part is pivotally connected to the turntable;

wherein, in a first operating state, the retard member and the rotary drum rotate coaxially, and the brake part is positioned without contacting with the frame; in a second operating state, the brake part is moved to be engaged with the frame, which fixes the turntable and the retard member such that the retard member is fixed, while the rotary drum rotates relative to the retard member, wherein a rotational friction is generated between the friction surface of the retard member and the inner surface of the rotary drum, which slows down the rotational speed of the rotary drum.

2. The fall protection device of claim 1, wherein a fit tolerance between the inner surface of the rotary drum and the friction surface of the retard member is between 0 mm and 0.3 mm.

3. The fall protection device of claim 1, wherein the retard member is press fitted into the rotary drum.

4. The fall protection device of claim 1, wherein the retard member has a plurality of ribs separately arranged, wherein an extension direction of each of the plurality of ribs is parallel to an axial direction of the shaft lever, and a top surface of each of the ribs forms the friction surface.

5. The fall protection device of claim 2, wherein the retard member has a plurality of ribs separately arranged, wherein an extension direction of each of the plurality of ribs is parallel to an axial direction of the shaft lever, and a top surface of each of the ribs forms the friction surface.

6. The fall protection device of claim 3, wherein the retard member has a plurality of ribs separately arranged, wherein an extension direction of each of the plurality of ribs is parallel to an axial direction of the shaft lever, and a top surface of each of the ribs forms the friction surface.

7. The fall protection device of claim 1, wherein the brake assembly further comprises a return spring, wherein the brake part is pivotally connected to the turntable, and the return spring is connected to the brake part and the turntable with two ends thereof respectively; in the first operating state, the brake part is pulled by the return spring to be positioned without contacting with the frame; in the second operating state, the brake part is swung to be engaged with the frame by a torque against to an elastic force of the return spring, which fixes the turntable and the retard member.

8. The fall protection device of claim 7, wherein the frame has a first stop portion; in the second operating state, a first portion of the brake part abuts against the first stop portion.

9. The fall protection device of claim 8, wherein the turntable has a second stop portion; in the second operating state, a second portion of the brake part abuts against the second stop portion.

10. The fall protection device of claim 1, further comprising a lateral cover and a spiral spring, wherein the lateral cover is received in the containing space, and is connected to the rotary drum; the lateral cover and the rotary drum rotate coaxially; the spiral spring is provided between the lateral cover and the rotary drum, and is fixed to the shaft lever and the lateral cover with two ends thereof respectively; the spiral spring is adapted to provide the rotary drum a restoring force to rewind the safety belt.

11. The fall protection device of claim 10, wherein the shaft lever has a groove recessed into an outer surface thereof, and an extending direction of the groove is parallel to an axial direction of the shaft lever; one of the two ends of the spiral spring is engaged with the groove.

12. The fall protection device of claim 10, wherein a plurality of protrusions are projected from an inner surface of the lateral cover, and are separately arranged; one of the two ends of the spiral spring is fixed between two adjacent protrusions among the plurality of protrusions.

* * * * *